US005900573A

United States Patent [19]

Barnes

[11] Patent Number: 5,900,573

[45] Date of Patent: May 4, 1999

[54] PERCUSSION ACCOMPANIMENT DEVICE

[76] Inventor: Owen R. Barnes, R.D. #1, Box 284-B, Kittanning Hollow Rd., East Brady, Pa. 16028

[21] Appl. No.: 08/868,440

[22] Filed: Jun. 3, 1997

[51] Int. Cl.[6] ..... G10D 15/00; G10H 1/32

[52] U.S. Cl. ..... 84/746; 84/171; 84/263; 84/267; 84/422.2

[58] Field of Search ..... 84/718, 721, 742, 84/743, 746, 7–15, 170–199, 263, 267, 422.1, 422.2, 422.3, 422.4

[56] References Cited

U.S. PATENT DOCUMENTS

| | | | |
|---|---|---|---|
| 134,679 | 1/1873 | Knaffl | 84/267 X |
| 398,176 | 2/1889 | Oerlein . | |
| 609,570 | 8/1898 | Bowden . | |
| 1,045,357 | 11/1912 | Anderson . | |
| 2,033,826 | 3/1936 | Haium | 84/173 |
| 2,581,515 | 1/1952 | Christian . | |
| 3,680,423 | 8/1972 | Lander | 84/267 X |
| 3,743,751 | 7/1973 | Ibanez | 84/742 X |
| 3,747,464 | 7/1973 | Russell . | |
| 3,967,523 | 7/1976 | Currier et al. | 84/422.1 |
| 4,028,984 | 6/1977 | Sanchez | 84/422.2 |
| 4,747,333 | 5/1988 | Hoshino . | |

FOREIGN PATENT DOCUMENTS

| | | |
|---|---|---|
| 1438506 | 5/1973 | United Kingdom . |

*Primary Examiner*—Stanley J. Witkowski
*Attorney, Agent, or Firm*—Titus & McConomy LLP

[57] ABSTRACT

The present invention relates to a device designed to accompany the playing of a guitar or other non-percussion instrument, which provides the capability for a musician to accompany his own playing of the guitar or other non-percussion instrument with a device which produces percussion while in simultaneous use with the guitar or other non-percussion instrument. The present invention is generally comprised of a member which mechanically strikes upon a sound-producing base, by means of an actuation device that is triggered by a mechanical or electrical impulse, initiated by the instrument player and transmitted by a triggering mechanism to the actuation device.

9 Claims, 2 Drawing Sheets

PERCUSSION ACCOMPANIMENT DEVICE

FIELD OF THE INVENTION

The present invention relates to a percussion instrument, and specifically to device designed to accompany the playing of a guitar or other non-percussion instrument.

BACKGROUND OF THE INVENTION

Percussion instruments are well known in the art, as are percussion instruments designed for foot operation. Also known in the art is the use of various percussion instruments in accompaniment of a musical guitar or other non-percussion instruments.

However, there is nothing currently known in the art which provides the capability for a musician to accompany his own playing of a guitar or other non-percussion instrument with a device which produces percussion while in simultaneous use with the guitar or other non-percussion instrument.

Accordingly, it is an object of the present invention to provide a musical accompaniment device which allows a musician to accompany his own playing of a guitar or other non-percussion instrument with percussion.

It is another object of the present invention to provide a musical accompaniment device which produces percussion while in simultaneous use with the guitar or other non-percussion instrument.

It is another object of the present invention to provide a mechanical musical accompaniment device which is attached to a guitar or other musical instrument to produce a tapping sound to accompany the music produced by that instrument.

It is another object of the present invention to provide a mechanical musical accompaniment device which is attached to a guitar or other musical instrument in such a manner as to utilize the acoustic characteristics of the instrument to which it is attached.

SUMMARY OF THE INVENTION

The present invention is generally comprised of a member which mechanically strikes upon a sound-producing base, by means of an actuation device that is triggered by a mechanical or electrical impulse, initiated by the instrument player and transmitted by a triggering mechanism to the actuation device.

The percussion accompaniment device of the present invention is generally mounted to the exterior shell of a guitar or other musical instrument in such a manner as to take advantage of the acoustic characteristics of the mounting instrument. When the instrument player triggers the actuation device, the striking member impacts the base to produce a vibration which reverberates through the mounting instrument to amplify itself and thereby produce a percussive sound to accompany the mounting instrument.

Other advantages of the present invention will become apparent from a perusal of the following detailed description of a presently preferred embodiment when taken in connection with the accompanying drawings.

DETAILED DESCRIPTION OF THE PRESENTLY PREFERRED EMBODIMENT

Figure 1A:
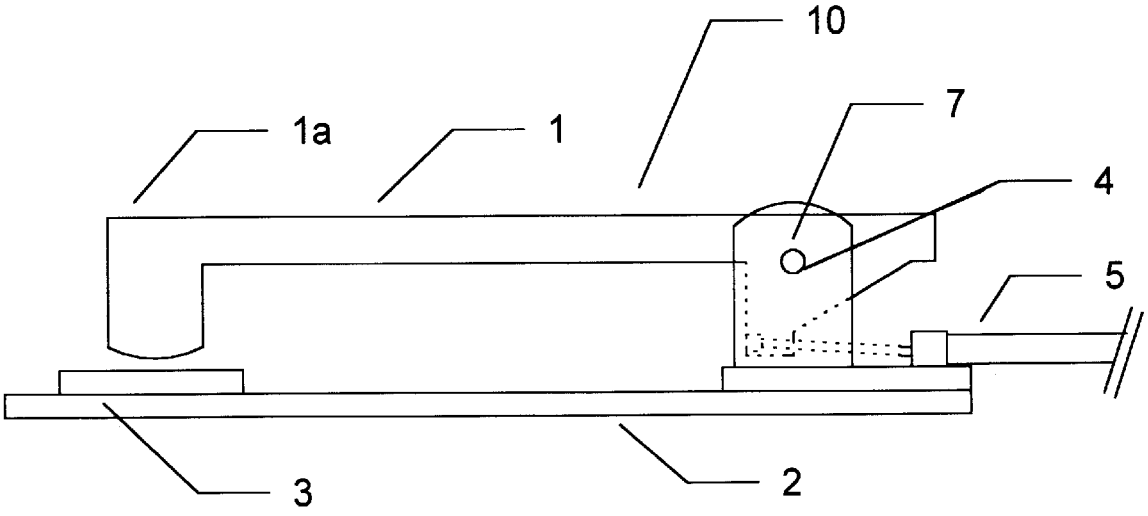
FIGS. 1A and 1B are side elevation views of the percussion accompaniment device of the present invention.
Figure 1B:
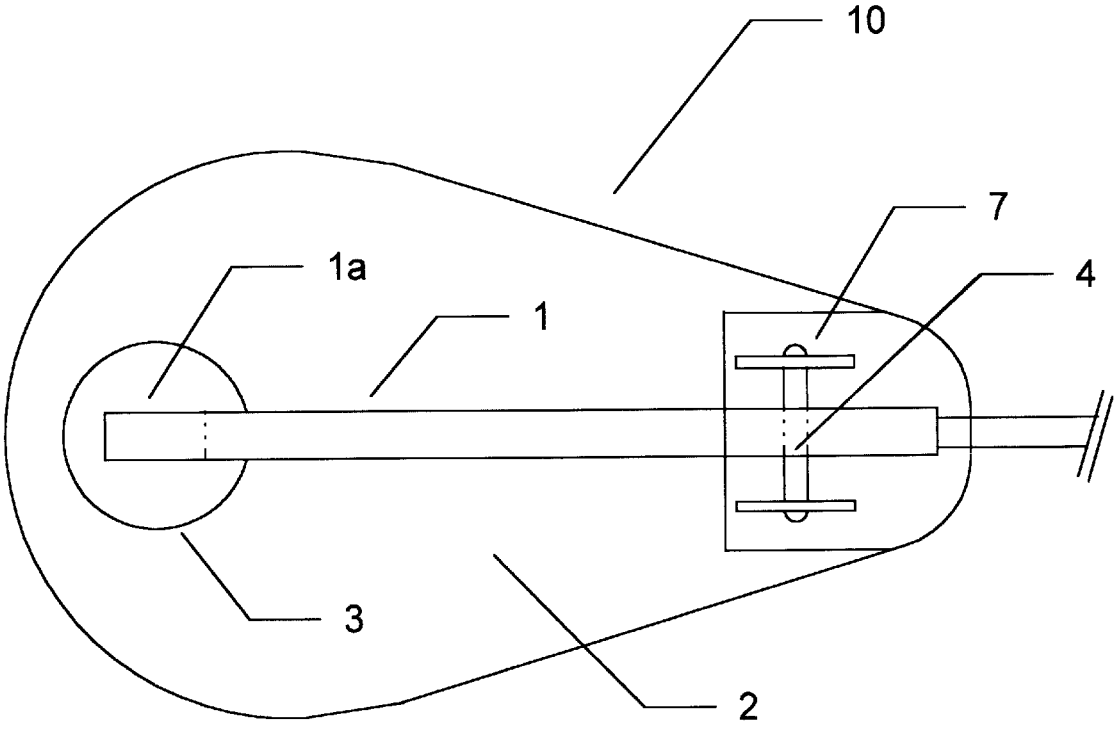

FIGS. 1A and 1B show the preferred embodiment of the percussion accompaniment device 10 of the present invention. The device consists of a striking member 1 which is mounted to a sound-producing base plate 2. The striker 1 has a head l*a* which is designed to impact a surface of a member 3 such as an anvil mounted to the base plate 2. The striker 1, base plate 2 and anvil member 3 can be made of any materials suitable for creating a sound vibration upon impact of the striker head 1*a* upon the anvil 3, including materials such as wood, metal, plastic, rubber or other suitable materials. The striker 1 can be secured to the base plate 2 by means of a hinge, a bracket, a pin-and-bushing arrangement or any other suitable means of attachment 7 known in the art. The striker 1 is actuated by means of a device 4 such as a spring, lever or other known mechanical or electrical actuation device suitable for bringing the striker 1 into contact with the anvil 3. The striker head 1*a* could be replaced with instruments which would produce qualitatively differing percussive sounds, such as drum-like, cymbal-like, castanet-like or washerboard-like sounds, among others.

Figure 2A:
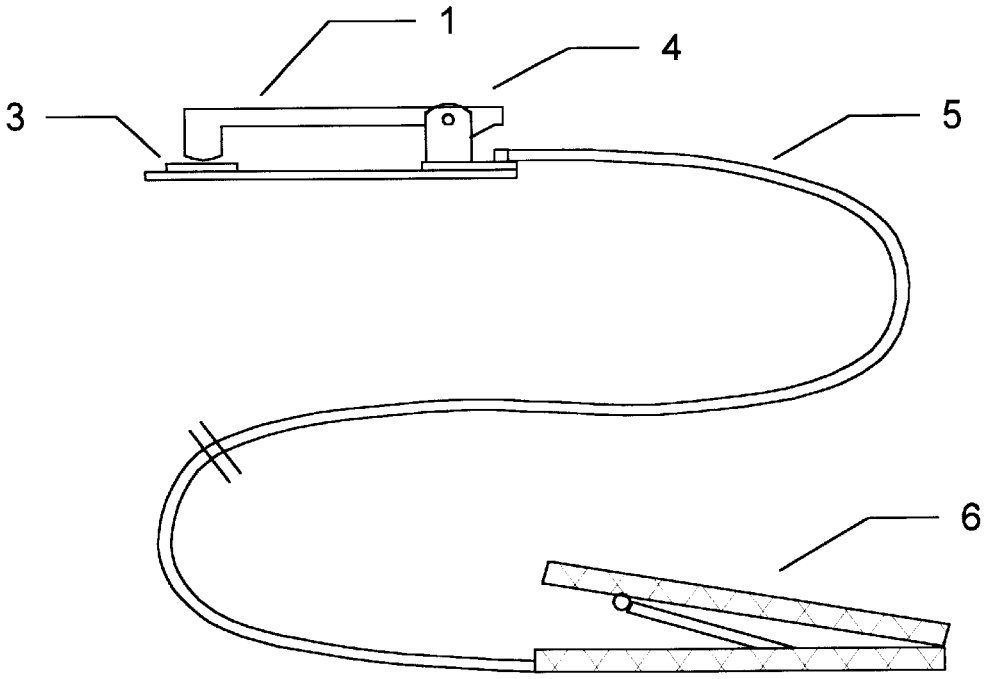
FIG. 2A is a side elevation view of the percussion accompaniment device of the present invention as configured with an actuating cable and foot pedal.
Figure 2B:
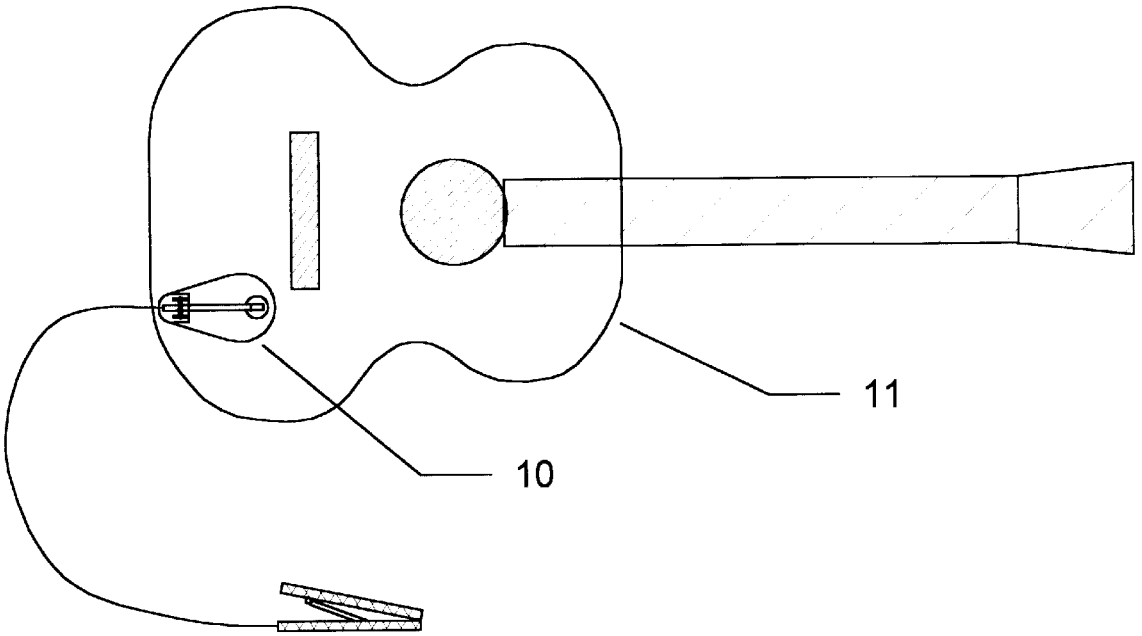
FIG. 2B is a side elevation view of the percussion accompaniment device of the present invention as mounted for use with a guitar.

As shown in FIG. 2A, the actuator 4 is attached to a cable 5 which transmits an electrical or mechanical impulse from a triggering mechanism 6, such as a foot pedal or other device suitable for this purpose, to the actuation device 4 to cause the striker 1 to come into contact with the anvil 3. As shown in FIG. 2B, the percussion accompaniment device 10 is mounted to the exterior shell of a guitar or other musical instrument in such a manner as to take advantage of the acoustic characteristics of the mounting instrument 11.

In operation, when the musician desires to produce sound from the percussion accompaniment device of the present invention, he or she actuates the triggering mechanism 6, such as by pressing on the foot pedal shown in FIGS. 2A and 2B. When the instrument player triggers the actuation device 4 by means of the triggering mechanism 6, the cable 5 sends an electrical or mechanical impulse to the striker 1, which then impacts the anvil 3 to produce a vibration which reverberates through the mounting instrument to amplify itself and thereby produce a percussive sound to accompany the mounting instrument 11.

While presently preferred embodiments of the invention have been shown and described in particularity, it may be otherwise embodied within the scope of the appended claims.

What is claimed is:

1. A device for generating percussive sound in accompaniment of a musical instrument by the player of said instrument simultaneous with the playing of said instrument, comprising:

A. a base portion mounted to said instrument for producing said percussive sound;

B. a striking member attached to said base portion for producing said percussive sound by impacting said base portion upon actuation of said striking member by a triggering signal;

C. a triggering mechanism connected to said striking member for providing said triggering signal to said striking member upon actuation of said triggering mechanism by the player of said device; and D. an actuator in communication with said triggering mechanism and said striking member for causing said striking member to impact said base portion upon receipt of said triggering signal.

2. The device of claim 1, further comprising a cable member connected to said actuator and to said triggering mechanism for transmitting said triggering signal.

3. The device of claim 1, wherein said triggering mechanism comprises a foot pedal.

4. The device of claim 1, wherein said actuator comprises a device selected from the group consisting of a mechanically operated device or an electrically operated device.

5. The device of claim 1, wherein said triggering signal is selected from the group consisting of a mechanical signal or an electrical signal.

6. The device of claim 1, wherein said striking member further comprises a head portion for impacting said base member upon actuation of said triggering mechanism.

7. The device of claim 1, wherein said device is mounted to the exterior of said instrument.

8. The device of claim 1, wherein said device is mounted to the exterior shell of a guitar.

9. The device of claim 1, wherein said striking member is configured to produce sounds selected from the group consisting of drum-like, cymbal-like, castanet-like and washerboard-like sounds.

* * * * *